United States Patent [19]

DeJager

[11] 4,429,851

[45] Feb. 7, 1984

[54] MOBILE HOME STABILIZER

[76] Inventor: Thomas M. DeJager, 39369 Oak View Rd., Yucaipa, Calif. 92399

[21] Appl. No.: 254,473

[22] Filed: Apr. 15, 1981

[51] Int. Cl.[3] ..... B60S 9/02

[52] U.S. Cl. ..... 248/354 S; 52/167; 280/763.1

[58] Field of Search ..... 52/263, 143, DIG. 11, 52/23, 156, 152, 167; 280/763, 762, 764; 212/145; 248/354 S

[56] References Cited

U.S. PATENT DOCUMENTS

| | | | |
|---|---|---|---|
| 2,943,752 | 7/1960 | Platt | 52/194 |
| 3,251,494 | 5/1966 | Pulliam | 248/354 S |
| 3,367,614 | 2/1968 | Leonard | 248/354 S |
| 3,430,911 | 3/1969 | Olson | 248/354 S |
| 3,750,349 | 8/1973 | Deike | 52/DIG. 11 |
| 3,801,128 | 4/1974 | Herdon | 280/763 |
| 3,923,286 | 12/1975 | Raugh | 248/354.4 |
| 3,933,372 | 1/1976 | Herndon | 280/763 |
| 4,148,162 | 4/1979 | Goodrich | 52/DIG. 11 |
| 4,322,925 | 4/1982 | Geisler | 52/143 |

*Primary Examiner*—John E. Murtagh
*Attorney, Agent, or Firm*—Allen A. Dicke, Jr.

[57] ABSTRACT

A pair of stabilizer legs act together to stabilize a mobile home against lateral shifting when subjected to earthquake shocks. Each stabilizer leg is engaged against the ground and against the mobile home, and the legs in the pair are stressed together to transfer lateral ground motion to the mobile home to prevent the mobile home from laterally shifting off of its jacks.

6 Claims, 3 Drawing Figures

FIG. 1
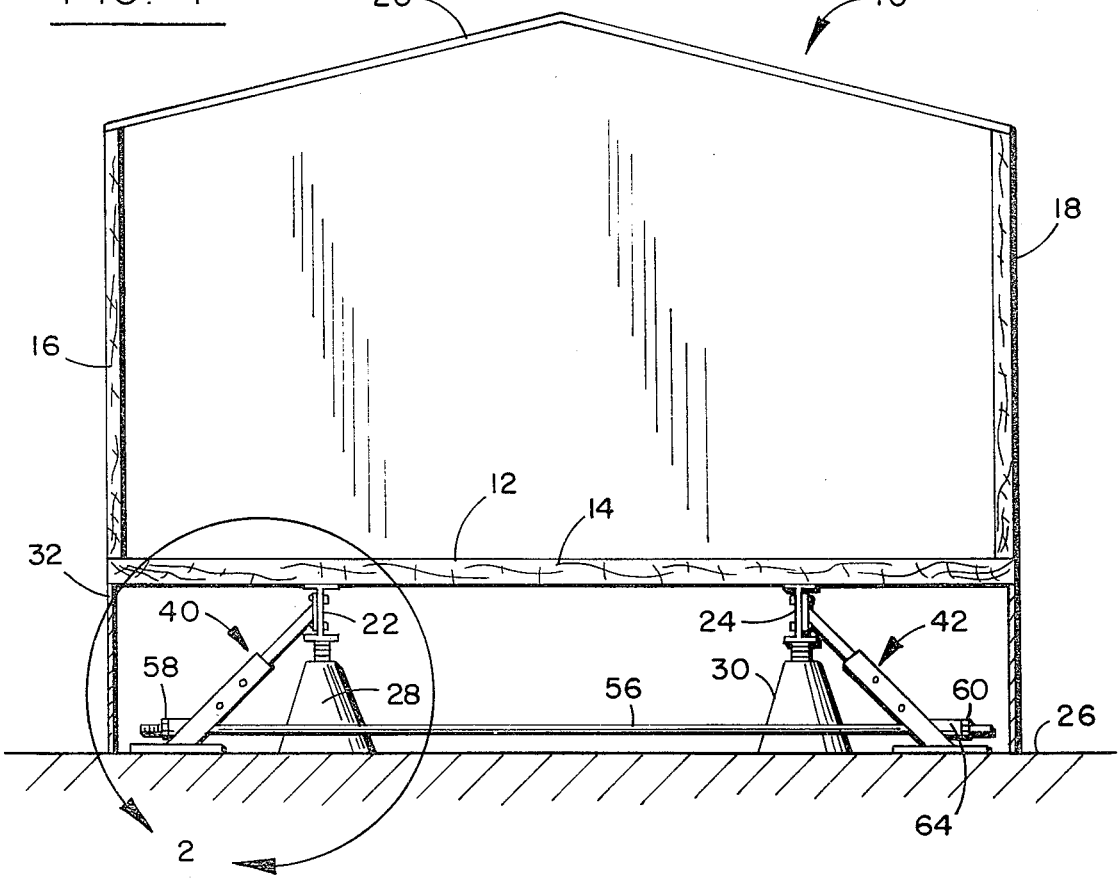
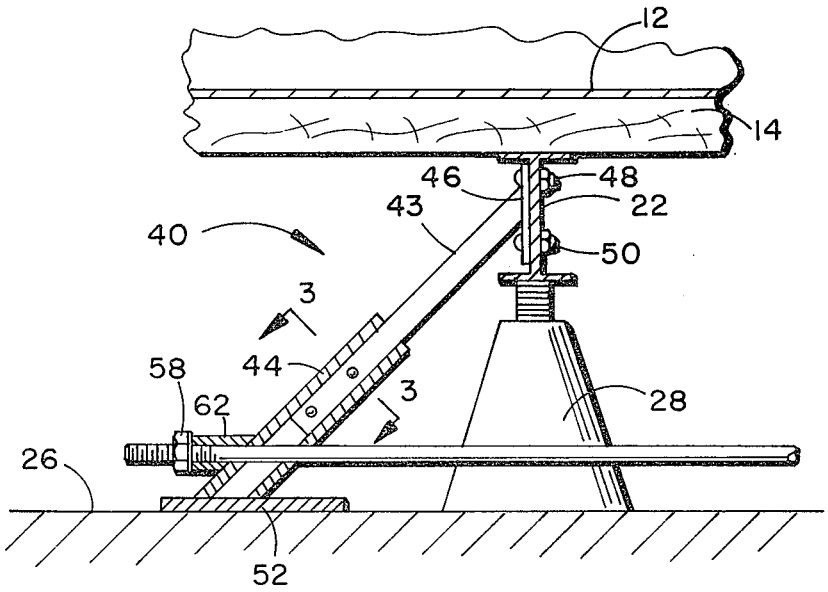
FIG. 2
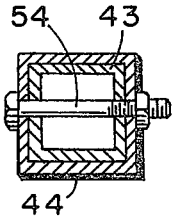
FIG. 3

MOBILE HOME STABILIZER

BACKGROUND

This invention is directed to a mobile home stabilizer in the form of stabilizer legs to stabilize the mobile home with respect to the ground.

The modern mobile home is a rectangular house-like enclosure which is built upon two longitudinal strength members, usually steel I-beams. These longitudinal I-beams are carried upon springs, axles and wheels for movement of the mobile home. When the mobile home is located in its permanent position, jacks are placed thereunder. The jacks engage upon the longitudinal strength members to support the mobile home in position. Since each mobile home is designed to be completely supported by these longitudinal strength members, the use of jacks only under the longitudinal strength members is adequate to rigidly support the mobile home. The jacks engage upon the ground and engage upon the underside of the longitudinal strength member and are not fastened to either.

This is adequate support for normal circumstances, but a problem arises when there is rapid ground movement. Earthquakes cause such ground movement often in a lateral direction. Such ground movement causes misalignment between the jacks and longitudinal strength members so that the mobile home, in effect, falls off its jacks. There is need to provide equipment which prevents this damage.

SUMMARY

In order to aid in the understanding of this invention, it can be stated in essentially summary form that it is directed to a mobile home stabilizer comprising at least one stabilizer leg for attachment to a mobile home and for support on the ground to inhibit lateral motion of the mobile home with respect to the ground.

It is thus an object of this invention to provide a mobile home stabilizer which aids in stabilizing a mobile home against earthquake damage by resisting lateral motion of a mobile home with respect to the ground to aid in maintaining the mobile home on its jacks. It is another object to provide a mobile home stabilizer which is sufficiently strong and is oriented in the proper direction to inhibit mobile home shifting during application of earthquake forces. It is a further object to provide a mobile home stabilizer which is economic of construction and is easy to install so that it can be widely employed, and yet is sufficiently strong to inhibit lateral shifting of a mobile home to which it is applied during the application of earthquake motions and forces. It is another object to provide a mobile home stabilizer which is adjustable so that it can be employed on mobile homes of different sizes and of different heights above the ground so that the stabilizer can be used in different sizes of installation.

Other objects and advantages of this invention will become apparent from a study of the following portion of the specification, the claims and the attached drawings.

BRIEF DESCRIPTION OF THE DRAWINGS

FIG. 1 is a transverse section through a mobile home, showing several of its supporting jacks, and the mobile home stabilizer of this invention.

FIG. 2 is an enlarged view of one of the jacks, indicated at 2—2 in FIG. 1.

FIG. 3 is an enlarged section taken generally along the line 3—3 of FIG. 2.

DESCRIPTION OF THE PREFERRED EMBODIMENT

A schematic example of a mobile home is generally indicated at 10 in FIG. 1 wherein it is shown in transverse section. Mobile home 10 has a floor 12 mounted on transverse floor joists 14. Walls 16 and 18 are mounted on the floor 12. Roof 20 reaches across the walls to enclose the interior of mobile home 10. Longitudinal strength members 22 and 24 extend lengthwise of mobile home 10 and support the floor joists. The longitudinal strength members 22 and 24 are the principal strength members of the mobile home, and conventionally, the wheels for the transport of the mobile home are mounted to these strength members.

When the mobile home 10 is positioned for home use at the site, it is located on the ground 26 in the orientation required. A plurality of jacks, two of which are shown at 28 and 30, are positioned under the mobile home in rows along each of the longitudinal strength members 22 and 24. The jacks are screwed up to engage under the members 22 and 24 to level and support the entire mobile home. The jacks are usually screw jacks so that the height of the jacks can be infinitely adjusted to provide leveling and distribution of the weight of the mobile home. A skirt 32 can optionally be positioned around the mobile home to enclose a space thereunder, which usually includes plumbing and electrical connections as well as the supporting equipment. That which is described above is conventional and does not provide for substantial lateral support. Lateral support is most usually required in case of earthquake, but windstorms may cause lateral movement of the mobile home with respect to the ground.

The mobile home stabilizer of this invention in its preferred embodiment comprises first and second stabilizer legs 40 and 42, see FIG. 1. Stabilizer leg 40 is shown in detail in FIGS. 2 and 3. It comprises rod 43 which telescopes into tube 44. Rod 43 carries pad 46 on its upper end at an acute angle with respect to the length of the rod. Pad 46 is bolted against the web of the I-beam which is longitudinal structural member 22. Bolts 48 and 50 are employed through appropriately drilled holes in both the pad and the I-beam web.

Foot 52 is secured on the bottom of tube 44 at an acute angle with respect to the length of the tube and at an angle so that it lies at substantially a right angle with respect to pad 46. Furthermore, the center line of the rod and tube is preferably about 45 degrees with respect to the plane of both the foot and the pad. A pair of bolts extends through the rod 43 and tube 44 to lock them together at a particular extension. The telescoping length adjustment is such that, with the pad bolted to the web of the longitudinal structural member, foot 52 can firmly engage the ground.

As is seen in FIG. 1, the two stabilizer legs 40 and 42 are respectively secured to the two longitudinal strength members 22 and 24 and are positioned so that their feet are outward from the jacks and strength members. In view of the angle of the stabilizer legs 40 and 42, if any appreciable downward load were applied, they would spread apart. In order to prevent this, tension bar 56 passes through both of the stabilizer legs, just above the respective feet thereon. Tension bar 56 is a cylindrical rod and carries nuts 58 and 60 threaded thereon. The tension bar extends through the tubular portion of the stabilizer legs, and tubular bosses 62 and 64 are provided so that the nuts have a square fit for proper tightening. Bosses 62 and 64 are tubes secured onto the outside of the respective tubes. Preferably, each of the permanent fastenings is made by welding. Pad 46 is welded to rod 43; foot 52 is welded to tube 44; and boss 62 is welded to tube 44. In this way, strength is achieved with economical and permanent attachments.

In use, after the mobile home 10 is supported on its jacks 28 and 30 and the companion jacks in a properly supported and level orientation, then two pairs of stabilizer legs are preferably installed. Stabilizer legs 40 and 42 form one pair and are preferably positioned from 20 to 25 percent of the length distance from one end, and the other pair is preferably positioned a similar distance from the other end. Appropriate holes are drilled in the webs of the longitudinal structural member I-beams, and the pads are bolted thereto. The feet 52 are adjusted to the ground, and cross bolts 54 are drilled and installed to make rigid the telescopic adjustment of the feet. Thereupon, tension bar 56 is installed and its nuts tightened so that the slack is taken out of the pair of stabilizer legs. The entire system comprised of two pairs of stabilizer legs is preferably designed to be sufficiently strong that the four legs can support the mobile home, even if all of the jacks are knocked loose. The mobile home 10 may engage in some twisting, but no substantial permanent damage is occasioned, as long as the mobile home stays up on its two pairs of stabilizer legs. The angularity of the legs inhibits falling of the mobile home as the result of earthquake caused ground movement or ground shifting caused by any causative factor. In this way, the chance of substantial damage to the mobile home 10 is reduced.

This invention has been described in its presently contemplated best mode, and it is clear that it is susceptible to numerous modifications, modes and embodiments within the ability of those skilled in the art and without the exercise of the inventive faculty. Accordingly, the scope of this invention is defined by the scope of the following claims.

What is claimed is:

1. A mobile home stabilizer system for stabilizing against lateral earth movement comprising:

first and second stabilizer legs, each said stabilizer leg having an upper end and a lower end, each said stabilizer leg being formed of a tube and a rod with said rod telescopically mounted for sliding motion within said tube for the length adjusment of said stabilizer leg, and fixing means is provided for fixing the length of said stabilizer leg at a predetermined length, a first pad on the upper end of said first stabilizer leg for rigid attachment to one of the longitudinal strength members of a mobile home, a second pad on the upper end of said second stabilizer leg for rigid attachment to another of the longitudinal strength members of the mobile home, a first substantially flat foot rigidly secured at the lower end of said first stabilizer leg for substantially non-penetrating engagement with the ground, a second substantially flat foot rigidly secured at the lower end of said second stabilizer leg for substantially non-penetrating engagement with the ground, said pad on each said stabilizer leg being positioned at substantially right angles with respect to said foot on said same stabilizer leg, said stabilizer legs being oriented at an acute angle between said feet and said pads and at an acute angle with respect to the ground and being directed away from each other so that said first and second feet are farther apart from each other stabilizer legs being oriented so that said first and second pads and second first and second feet substantially lie in a plane which lies substantially at right angles to the longitudinal strength members; and connection means on said first and second stabilizer legs for attaching said first stabilizer leg to said second stabilizer leg so that upon lateral movement said stabilizer legs move with the mobile home.

2. The mobile home stabilizer system of claim 1 wherein a bolt is positioned through said tube and said rod to fix the length of said stabilizer leg.

3. The mobile home stabilizer system of claim 1 wherein said connection means is a tension bar interconnected between said stabilizer legs adjacent their feet.

4. A mobile home stabilizer system comprising first and second stabilizer legs, each of said legs having an upper and a lower end;

a pad rigidly attached to said upper end of each of said stabilizer legs, each said pad being for rigid attachment to a different mobile home longitudinal strength member;

a foot rigidly secured on the lower end of each of said stabilizer legs, each said foot being substantially flat for substantially non-penetrating ground engagement, said pad on the upper end of each of said stabilizer legs being positioned at substantially right angles with respect to said foot at the lower end of each of said legs, and said legs being each acutely angularly oriented with respect to said feet, said stabilizer legs being for rigid attachment to separate spaced longitudinal strength members of a mobile home with said feet being father apart than said pads and said stabilizer legs being angularly oriented with respect to said feet to provide vertical and lateral support for a mobile home; and a tension member for attachment between said stabilizer legs adjacent the feet thereon for inhibiting spreading of said feet on said stabilizer legs to provide lateral support so that upon lateral ground movement said stabilizer legs move with the mobile home system.

5. The mobile home stabilizer system of claim 4 wherein each of said stabilizer legs is adjustable.

6. The mobile home stabilizer system of claim 5 wherein each of said stabilizer legs comprises a tube and a bar telescopically engaged with respect to each other, and locking means is provided for rigidly locking each said stabilizer leg in a selected length position.

* * * * *